US008966923B2

(12) United States Patent
Haussmann

(10) Patent No.: US 8,966,923 B2
(45) Date of Patent: Mar. 3, 2015

(54) COUPLING UNIT FOR CONNECTING THE REFRIGERANT LINES OF A REFRIGERANT CIRCUIT

(75) Inventor: Roland Haussmann, Wiesloch (DE)

(73) Assignee: Valeo Klimasysteme GmbH, Bad Rodach (DE)

( * ) Notice: Subject to any disclaimer, the term of this patent is extended or adjusted under 35 U.S.C. 154(b) by 116 days.

(21) Appl. No.: 13/521,681

(22) PCT Filed: Jan. 5, 2011

(86) PCT No.: PCT/EP2011/050110
§ 371 (c)(1),
(2), (4) Date: Nov. 6, 2012

(87) PCT Pub. No.: WO2011/083129
PCT Pub. Date: Jul. 14, 2011

(65) Prior Publication Data

US 2013/0042643 A1 Feb. 21, 2013

(30) Foreign Application Priority Data

Jan. 11, 2010 (DE) ..... 10 2010 004 294.3

(51) Int. Cl.
*F25D 19/00* (2006.01)
*F25B 41/06* (2006.01)
*F25B 39/02* (2006.01)

(52) U.S. Cl.
CPC ..... *F25B 41/062* (2013.01); *F25B 39/028* (2013.01); *F25B 2341/0683* (2013.01)
USPC ..... 62/299; 62/525; 62/527

(58) Field of Classification Search
CPC ..... F25B 41/003; F25B 39/02; F25B 2400/0411; F24F 13/20
USPC ..... 62/299, 298, 525, 527; 29/521, 757; 285/206, 123.8, 139.1
See application file for complete search history.

(56) References Cited

U.S. PATENT DOCUMENTS 2,148,413 A 2/1939 Labberton et al.
3,866,439 A * 2/1975 Bussjager et al. ..... 62/504

(Continued)

FOREIGN PATENT DOCUMENTS

EP 1128138 A2 8/2001
EP 1431085 A1 6/2004
JP 2001-026213 A 1/2001

OTHER PUBLICATIONS

English language abstract and translation for JP 2001-026213 extracted from the PAJ database on Sep. 14, 2012, 38 pages.

(Continued)

*Primary Examiner* — Mohammad M Ali
(74) *Attorney, Agent, or Firm* — Howard & Howard Attorneys PLLC

(57) ABSTRACT

The invention relates to a coupling unit (16) for connecting refrigerant lines (11) of a refrigerant circuit (10), in particular for cooling a vehicle drive module, said coupling unit including an expansion valve (20) accommodated in the coupling unit (16), said expansion valve (20) separating the refrigerant circuit (10) into a first and a second sub-areas (30, 32), said coupling unit (16) being connected directly to a refrigerant feed and a refrigerant return for an evaporator (26), said coupling unit (16) respectively comprising a coupling connection (36, 38) of the refrigerant feed and the refrigerant return, which are detachably connected to the expansion valve (20) via a common fastening device (44), and with the common fastening device (44) having at least one fastening element (48) that is accessible for connecting and disconnecting from a side of the expansion valve (20) that faces away from the coupling connections (36, 38).

20 Claims, 6 Drawing Sheets

(56) References Cited

U.S. PATENT DOCUMENTS

| | | | | |
|---|---|---|---|---|
| 3,875,759 | A * | 4/1975 | Malcosky et al. | 62/394 |
| 3,977,205 | A * | 8/1976 | Dreisziger et al. | 62/117 |
| 4,253,315 | A * | 3/1981 | Fiedler | 62/404 |
| 4,468,054 | A | 8/1984 | Orth | |
| 5,354,101 | A | 10/1994 | Anderson, Jr. | |
| 5,732,570 | A | 3/1998 | Tomatsu et al. | |
| 5,987,916 | A * | 11/1999 | Egbert | 62/498 |
| 6,023,940 | A | 2/2000 | Abbott et al. | |
| 6,148,631 | A * | 11/2000 | Watanabe et al. | 62/296 |
| 6,189,333 | B1 | 2/2001 | Cummings et al. | |
| 7,237,481 | B2 * | 7/2007 | Joos | 101/148 |
| 7,600,393 | B2 * | 10/2009 | Kim | 62/504 |
| 2004/0011078 | A1 * | 1/2004 | Kobayashi et al. | 62/527 |
| 2004/0026524 | A1 | 2/2004 | Yano et al. | |
| 2004/0154326 | A1 * | 8/2004 | Hosokawa | 62/244 |
| 2004/0163399 | A1 * | 8/2004 | Kim | 62/222 |
| 2005/0262872 | A1 * | 12/2005 | Sacks et al. | 62/500 |
| 2006/0201197 | A1 * | 9/2006 | Kim | 62/504 |

OTHER PUBLICATIONS

International Search Report for Application No. PCT/EP2011/050110 dated Aug. 26, 2011, 4 pages.

* cited by examiner

COUPLING UNIT FOR CONNECTING THE REFRIGERANT LINES OF A REFRIGERANT CIRCUIT

RELATED APPLICATIONS

This application is the National Stage of International Patent Application No. PCT/EP2011/050110, filed on Jan. 5, 2011,which claims priority to all the advantages of German Patent Applications No. DE 10 2010 004294.3, filed on Jan. 11 2010.

The invention relates to a coupling unit for connecting the refrigerant lines of a refrigerant circuit, in particular for cooling a vehicle drive module.

In refrigerant circuits, various components are connected by refrigerant lines. Depending on the spatial layout of the refrigerant circuit on an object to be refrigerated, it may be difficult to connect and disconnect the refrigerant lines, for example for replacing a component of the refrigerant circuit.

Further, refrigerant circuits are known in which the refrigerant is divided into several sub-lines at a throttle point. In order to obtain the same refrigerating capacity of all sub-lines, an even distribution of the gas-liquid mix of the refrigerant has to be ensured. This may be problematic especially when the refrigerant circuit is installed in a vehicle, for example for cooling a battery in an electric or hybrid vehicle, because acceleration forces occur and the spatial position of the vehicle changes, for example as the vehicle drives up or down a gradient.

It is the object of the invention to provide a coupling unit for connecting refrigerant lines of a refrigerant circuit, which enables a simple connecting and disconnecting of the refrigerant lines. It is a further object of the coupling unit to enable an even distribution of the refrigerant to various sub-lines independent from the spatial position of the refrigerant circuit or from externally acting forces.

This object is achieved by means of a coupling unit according to the invention for connecting refrigerant lines of a refrigerant circuit, in particular for cooling a vehicle drive module, said coupling unit having an expansion valve accommodated in the coupling unit, said expansion valve separating the refrigerant circuit into a first and a second sub-area. The coupling unit is connected directly to a refrigerant feed and a refrigerant return for an evaporator, said coupling unit respectively comprising a coupling connection for the refrigerant feed and for the refrigerant return, which are detachably connected to the expansion valve via a common fastening device. The common fastening device includes at least one fastening element that is accessible for connecting and disconnecting from a side of the expansion valve, which faces away from the coupling connections. Thus, the refrigerant lines may be disconnected from the expansion valve or connected to the expansion valve in a simple manner, when the side of the expansion valve, which faces away from the coupling connections, is not accessible. The assembly of the refrigerant circuit is simplified and replacement of the expansion valve is made easier.

For example, the expansion valve is mounted on a wall of the coupling unit, in particular on a housing wall that is penetrated by the coupling connections.

Preferably, the common fastening device clamps the wall and the expansion valve together. This allows both the wall and the coupling connections of the refrigerant feed and the refrigerant return to be fastened to the expansion valve by means of the common fastening device.

In order to seal the location of the wall where it is penetrated by the coupling connections, a seal may be provided between the wall and the expansion valve.

An optimal compression of the seal may be achieved by placing the seal in a groove in the wall, with the depth of the groove determining a maximum compression of the seal.

It is possible for the seal to be integrally formed with the wall, preferably by two-component injection moulding.

According to one embodiment, the expansion valve, the refrigerant feed and the refrigerant return are connected to each other to form a unit that is movably supported on the wall of the coupling unit, as a result of which tolerances and thermal expansions can be compensated. In particular, the wall surrounds the feed and the return as well as the valve, so that the unit is movably received in a kind of housing.

A seal may be provided between the wall and the refrigerant feed as well as the refrigerant return. This enables the location where the wall is penetrated by the refrigerant lines to be sealed independently from the expansion valve.

Preferably, the wall includes a cylindrical wall section that extends in the direction of the refrigerant feed and the refrigerant return, said seal bearing against the refrigerant feed, the refrigerant return and the cylindrical wall section being preferably movable relative to the wall section and/or the refrigerant feed, the refrigerant return. In this way, the contact surface of the seal is increased and any tolerances in the positioning of the seal relative to the wall are compensated.

The relative movement of the seal allows some play that may be limited for example by means of a wall stop.

According to one embodiment, the seal comprises a sealing body which is preferably made from a substantially rigid material, on which inner sealing elements for providing a seal between the sealing body and the refrigerant feed as well as the refrigerant return and an outer sealing element for providing a seal between the sealing body and the wall are provided, with the inner and/or outer sealing elements preferably being integrally moulded to the sealing body, in particular by two-component injection moulding. A sealing body of this type allows the refrigerant feed and the refrigerant return to be sealed in a common recess of the wall, especially if the geometries of the lines and of the recess of the wall do not match.

The sealing body is preferably in multiple pieces, in particular in two pieces, with the pieces of the sealing body preferably being detachably connected to each other. This allows a simple assembly and a simple replacement of the sealing body on the two lines, by attaching the pieces of the sealing body to the lines in a radial direction.

The sealing body is separated particularly along a plane through the centre of the refrigerant feed and/or the refrigerant return.

In order to seal the refrigerant circuit on the coupling unit, a seal may respectively be provided between the coupling connections of the refrigerant return and the refrigerant feed and the expansion valve.

Preferably, at least one coupling connection of the refrigerant feed and/or of the refrigerant return has a lateral projection which is positioned and fixed between a pressing part of the common fastening device and the expansion valve. The lateral projection of the coupling connection allows a simple positive fixing of the coupling connection on the expansion valve in an axial direction. An example of such a projection is an annular flange.

It is possible for at least one coupling connection of the refrigerant feed and/or the refrigerant return to have a lateral indentation, in which a common pressing part engages and fixes the coupling connections in an axial direction. In this way, a simple positive connection between the pressing part and the coupling connections of the refrigerant feed and/or the refrigerant return is made possible.

The pressing part may be a comb-shaped plate that can be laterally pushed onto the coupling connections.

Moreover, the invention relates to a coupling unit for connecting refrigerant lines of a refrigerant circuit, in particular for cooling a vehicle drive module having a throttle point accommodated in the coupling unit, preferably an expansion valve, and at least one refrigerant line arranged in the refrigerant circuit downstream of the throttle point. The coupling unit comprises a refrigerant distributor having at least two sub-lines combined in the refrigerant distributor, said refrigerant distributor being a coupling connection of the refrigerant line, which forms part of the coupling line and to which the refrigerant line is connected. Since the refrigerant distributor and the throttle point are jointly integrated in the coupling unit, there will be no or only a minor segregation of the liquid and gaseous phases of the refrigerant on the refrigerant distributor after the throttle point. Thus, an even distribution of the liquid phase of the refrigerant to the various sub-lines of the refrigerant distributor takes place. This variant may optionally also be combined with the aforementioned variant that is directed to assembly (from the side facing away from the coupling connections).

According to a preferred embodiment, the hydraulic cross section of the refrigerant line remains constant from the throttle point to the refrigerant distributor.

The hydraulic cross section is preferably between 3 and 8 mm.

It has been found that the length of the refrigerant line between the throttle point and the refrigerant distributor amounts to for example 2 to 10 times the hydraulic cross section of the refrigerant line.

The coupling connection may be manufactured directly by moulding the refrigerant return and/or the refrigerant feed. This allows a simple one-piece implementation of the coupling connection with the corresponding refrigerant line.

Alternatively, the coupling connection may be a separately produced component which is preferably produced in one piece by turning or milling. This allows a complex geometry of the coupling connection.

Further features and advantages of the invention will become evident from the description given below and from the attached drawings to which reference will be made and wherein.

Figure 1:
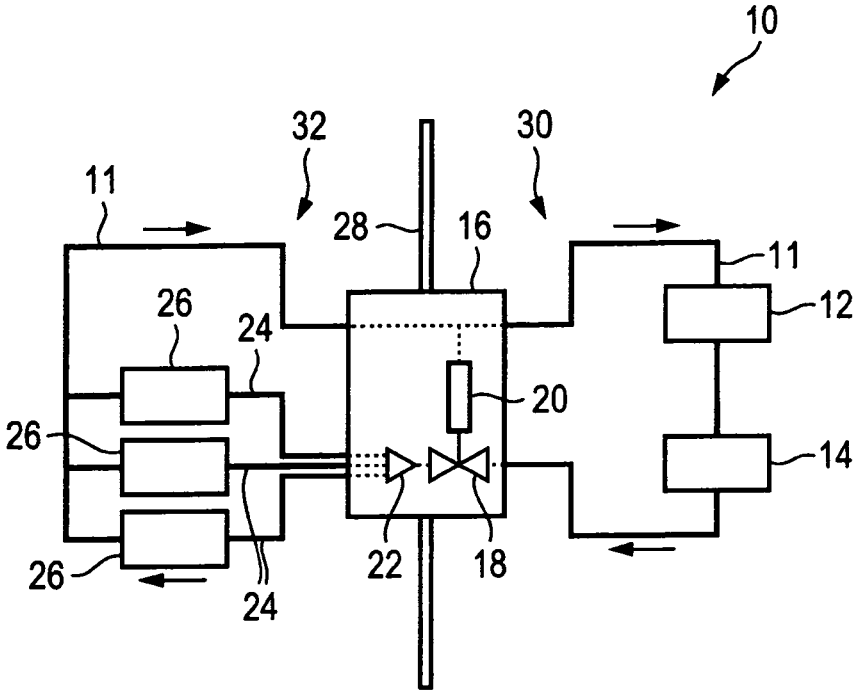
FIG. 1 shows a schematic view of a refrigerant circuit having a coupling unit according to the invention.

FIG. 1 shows a schematic view of a refrigerant circuit 10. The refrigerant circuit 10 includes refrigerant lines 11, through which fluid flows in the direction indicated by the arrows.

The refrigerant circuit 10 comprises a compressor 12 in which the refrigerant is compressed and a condenser 14 in which the refrigerant is cooled and condensed.

A coupling unit 16 has a throttle point 18 that is formed as an expansion valve 20, and a refrigerant distributor 22 that divides the refrigerant line 11 into several sub-lines 24. An evaporator 26 is provided in each sub-line 24, which is particularly arranged to cool a vehicle drive module, for example a vehicle propulsion battery of a purely battery driven or a hybrid vehicle.

The refrigerant is returned from the evaporators 26 via a common refrigerant line 11, which in turn leads through the coupling unit 16 to the compressor 12 and closes the refrigerant circuit 10.

The coupling unit 16 is provided in a wall 28 which separates the refrigerant circuit 10 into a first sub-area 30 including the compressor 12 and the condenser 14 and a second sub-area 32 including the evaporators 26.

The wall 28 may for example be a housing, within which the components to be cooled are located, i.e. for example the battery housing. The compressor 12 and the condenser 14 are here arranged outside the housing, whereas the evaporators 26 are arranged within the housing.

Figure 2:
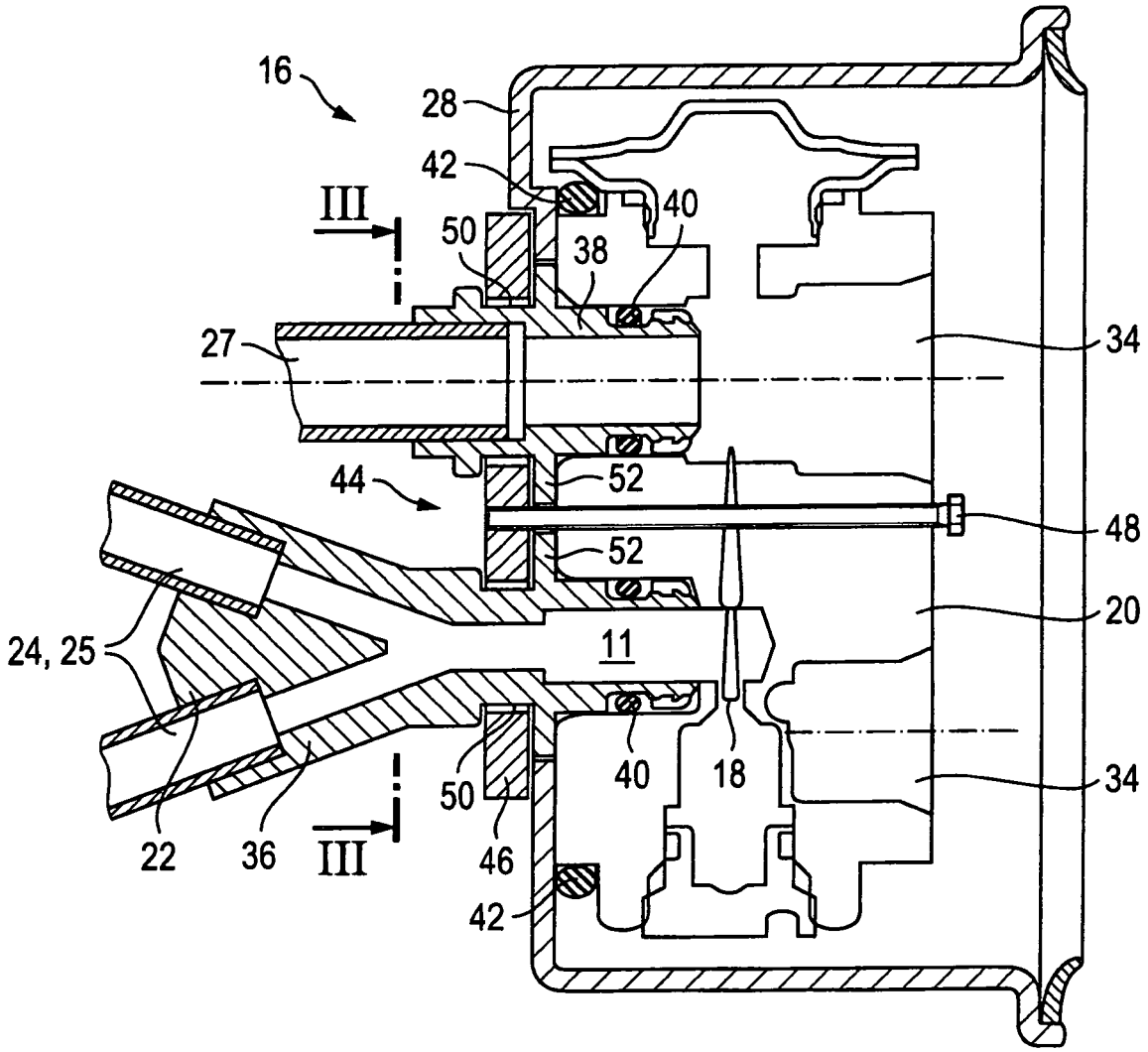
FIG. 2 shows a lateral sectional view of a coupling unit according to the invention.

FIG. 2 shows a lateral sectional view of the coupling unit 16. The expansion valve 20 is mounted on the right-hand side of the wall 28 and is thus positioned in the first sub-area 30 of the refrigerant circuit 10.

The expansion valve 20 has two connections 34 which are not described in more detail and by means of which the expansion valve 20 is connected to the refrigerant lines 11 which lead to the compressor 12 and to the condenser 14.

On the left-hand side of the expansion valve 20, a first coupling connection 36 which is associated with a refrigerant feed 25 of the evaporator 26 and a second coupling connection 38 which is associated with a coolant return 27 from the evaporators 26 are located.

Each of the two coupling connections 36, 38 penetrates the wall 28 and protrudes into the expansion valve 20. Between the first and second coupling connections 36, 38 and the expansion valve 20, an annular seal 40 is respectively provided, which in the embodiment shown in FIG. 2 are each positioned in a groove of the first and the second coupling connections 36, 38.

A further seal 42 is provided between the wall 28 and the expansion valve 20 and seals the transition between the first sub-area 30 and the second sub-area 32 of the refrigerant circuit 10.

The two coupling connections 36, 38, which form for example a type of pipe connecting sleeve, are fastened to the expansion valve 20 and to the wall 28 by means of a common fastening device 44. The common fastening device 44 comprises a common pressing part 46 and a fastening element 48 that is accessible for connecting and disconnecting the fastening device 44 from a side of the expansion valve 20, which faces away from the coupling connections 36, 38.

In the embodiment shown, the pressing part 46 engages positively in a lateral indentation 50 of the first and second coupling connections 36, 38 and is pulled by the fastening element 48 in the form of a screw from the side of the expansion valve 20, which is associated with the first sub-area 30 of the refrigerant circuit 10, in the direction of the expansion valve 20, as a result of which the coupling connections 36, 38 and the wall 28 are pressed against the expansion valve 20.

The pressing part 46 presses against a contact surface that is respectively formed by lateral projections 52 of the first and second coupling connections 36, 38, and moreover is supported (at the top and the bottom in relation to FIG. 2) on the wall 28.

In the embodiment shown, the lateral indentation 50 and the lateral projection 52 are each formed to be symmetrically annular. It is also possible for the lateral indentation 50 or the lateral projection 52 to extend only over sub-areas of the circumference of the first and/or the second coupling connection(s) 36, 38. In this way, for example, an additional fastening of the coupling connection 36, 38 in the circumferential direction on the expansion valve 20 and/or the wall 28 is made possible.

The coupling connections 36, 38 are axially fixed through the lateral indentation 50 and the lateral projection 52 via the pressing part 46.

The axial direction is to be understood to mean in each case the direction of the corresponding refrigerant line 11.

The first coupling connection 36 is implemented as a refrigerant distributor 22. Since in this way, the refrigerant distributor 22 is positioned very closely to the throttle point 18 of the expansion valve 20, there will only be an insignificant segregation of the gas-liquid mix of the refrigerant after the throttle point 18 up to the refrigerant distributor 22. Thus the refrigerant is evenly distributed over the sub-lines 24 that are connected to the refrigerant distributor 22. The distribution is essentially dependent on the spatial layout of the refrigerant distributor 22 or on external forces, for example on acceleration forces in a vehicle.

In the embodiment of the refrigerant distributor 22 as shown in FIG. 2, the refrigerant line 11 has a first hydraulic diameter immediately downstream of the throttle point 18, which diameter is reduced to a second hydraulic diameter shortly before the branching point of the sub-lines 24. In the area of the reduced hydraulic diameter, the flow rate of the refrigerant is increased as a result of the Venturi effect.

The throttle point 18 is positioned in the expansion valve 20 in such a way that the refrigerant line 11 extends at an angle of 90° to the flow direction of the throttle point 18. The refrigerant flowing through the throttle point 18 at a high velocity impinges vertically on the wall of the refrigerant line 11 and the refrigerant is intensely mixed.

Figure 3:
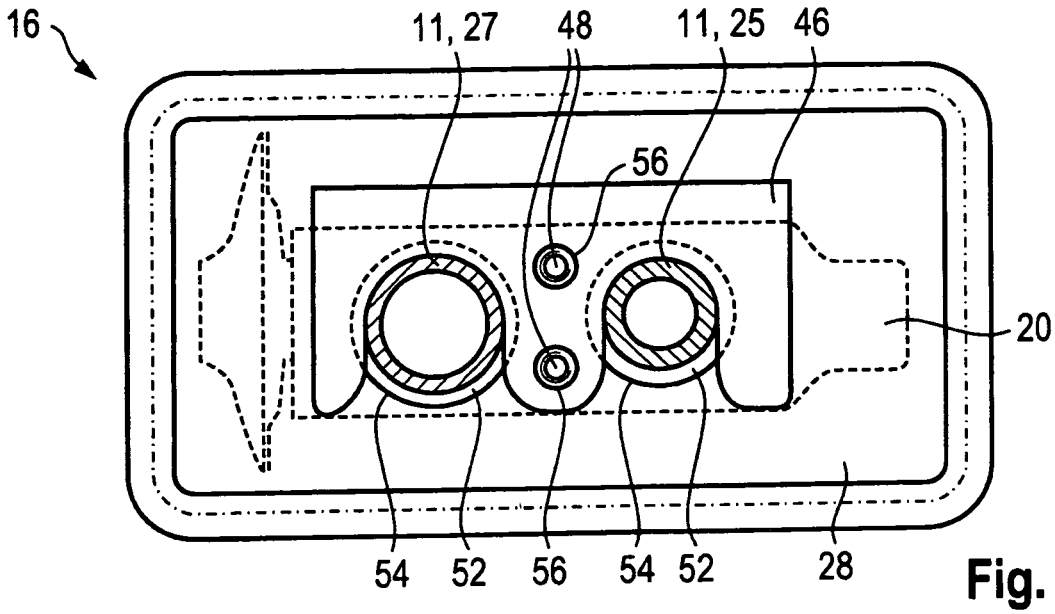
FIG. 3 shows a sectional view of the coupling unit along the line III-III in FIG. 2.

FIG. 3 shows a top view of the coupling unit 16 according to the sectional plane shown in FIG. 2, wherein, however, the coupling unit 16 is shown in a lying position and not in a standing position as in FIG. 2. The expansion valve 20 which is located behind the wall 28 is shown in dotted lines. In the wall 28, two circular recesses 54 are provided, through which the coupling connections 36, 38 protrude.

As can be readily seen in this view, the pressing part 46 is formed as a comb-shaped plate that can be laterally pushed onto the coupling connections 36, 38.

The pressing part 46 bears both against the lateral projections 52 of the coupling connections 36, 38 and against the wall 28.

In the pressing part 46, two threaded bores 56 for two fastening elements 48, which are here implemented as screws, are provided which allow the pressing part 46 to be axially clamped against the wall 28 and the coupling connections 36, 38.

Figure 4:
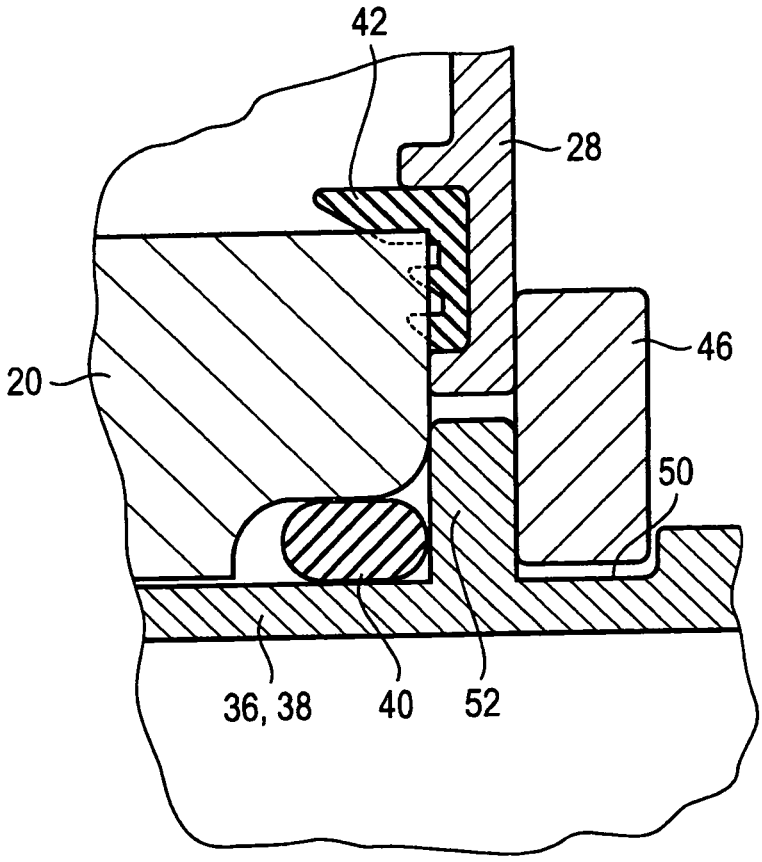
FIG. 4 shows a detailed sectional view of a coupling unit according to the invention.

FIG. 4 shows a detailed view of the fastening means and the seals of the coupling unit 16. The first or second coupling connection 36, 38 has a lateral projection 52 and a lateral indentation 50. The pressing part 46 positively protrudes into the lateral indentation 50 of the coupling connection 36, 38, as a result of which the pressing part 46 is fixed in an axial direction relative to the coupling connection 36, 38.

The pressing part 46 bears both against the lateral projection 52 and against the wall 28 and thus fixes the expansion valve 20, the wall 28 and the coupling connection 36, 38 relative to each other. A first seal 40 is provided between the coupling connection 36, 38 and the expansion valve 20. In the embodiment shown in FIG. 4, the seal 40 is located in a recess in the housing of the expansion valve 20.

A second seal 42 is provided between the wall 28 and the expansion valve 20. The seal 42 is positioned in a groove in the wall 28, with the depth of the groove determining a maximum compression of the seal 42. In this way, an optimal sealing function of the seal 42 is ensured.

The seal 42 surrounds an edge of the expansion valve 20, with the seal bearing against both surfaces of the edge, thus enhancing the sealing function.

The seal 42 may be a separate component which is inserted in the groove of the wall 28 or may be integrally moulded to the wall 28, and said wall 28 with the seal 24 may for example be produced by way of a two-component injection moulding process.

In the embodiments shown, both the first and the second coupling connections 36, 38 are formed as a one-piece component that is produced separately by turning or milling, which component is connected to the refrigerant lines 11 or to the sub-lines 24.

Alternatively it is possible for the first or second coupling connection 36, 38 to be made by moulding the coolant return and/or the coolant feed.

Figure 5:
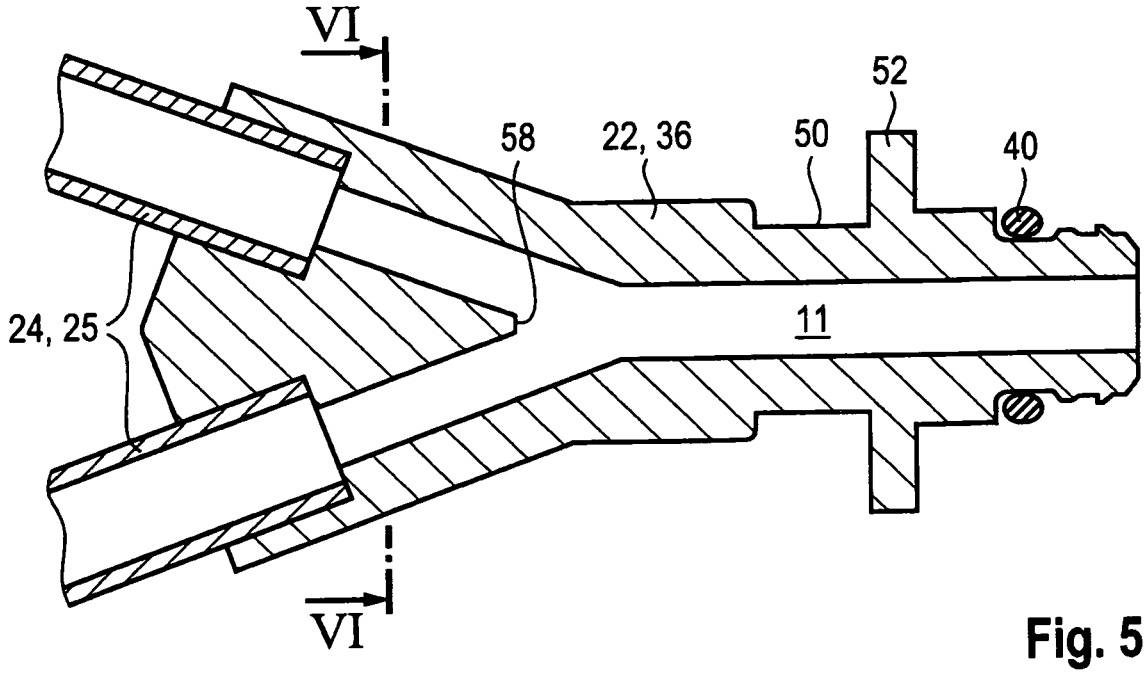
FIG. 5 shows a lateral sectional view of the refrigerant distributor from FIG. 2.

FIG. 5 shows a detailed view of a refrigerant distributor 22 according to a further embodiment. The refrigerant distributor is formed as a joint component with the coupling connection 36.

On the right-hand side of the refrigerant distributor 22, a refrigerant line 11 having a constant hydraulic cross section is formed. The outside of the refrigerant distributor 22 has a groove in which the first seal 40 is disposed, as well as a lateral projection 52 and a lateral indentation 50 for fixing the refrigerant distributor 22 in the axial direction by means of the pressing part 46 of the coupling unit 16.

The division of the refrigerant line 11 into several sub-lines 24 takes place at a cusp 58 of the refrigerant distributor.

The hydraulic cross section of the refrigerant line 11 from the throttle point 18 to the cusp of the refrigerant distributor 22 is between 3 and 8 mm.

The length of the refrigerant line 11 between the throttle point 18 of the expansion valve 20 and the cusp 58 of the refrigerant distributor 22 amounts to 2 to 10 times the hydraulic cross section of the refrigerant line 11.

Figure 6:
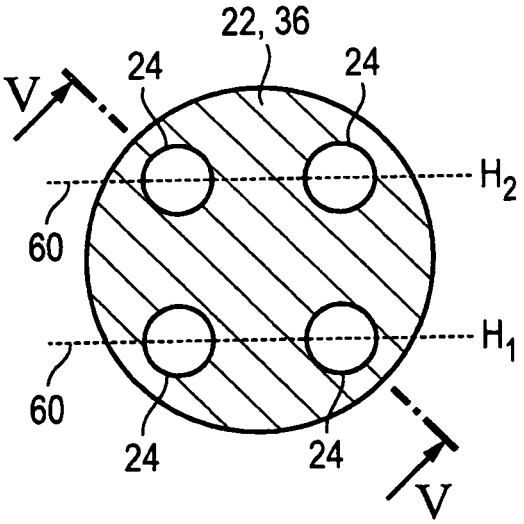
FIG. 6 shows a sectional view of the refrigerant distributor along the line VI-VI in FIG. 5.

As can be seen in FIG. 6, the refrigerant distributor 22 divides the refrigerant line 11 into four sub-lines 24. Preferably, the refrigerant distributor 22 is mounted on the expansion valve in such a way that respectively two sub-lines 24 are located on the same level 60. When installing the system in a vehicle, it can also be considered here that the two sub-lines 24 will be on the same level 60 even in the case of a pitch motion of the vehicle.

The refrigerant distributor 22 shown in FIG. 5 and in FIG. 6 is formed in such a way that the refrigerant liquid mass flow is the same in all sub-lines 24. Alternatively, for example, different cross sections may be provided for the various sub-lines 24, as a result of which a desired ratio of the refrigerant liquid mass flow of different sub-lines may be adjusted.

Figure 7:
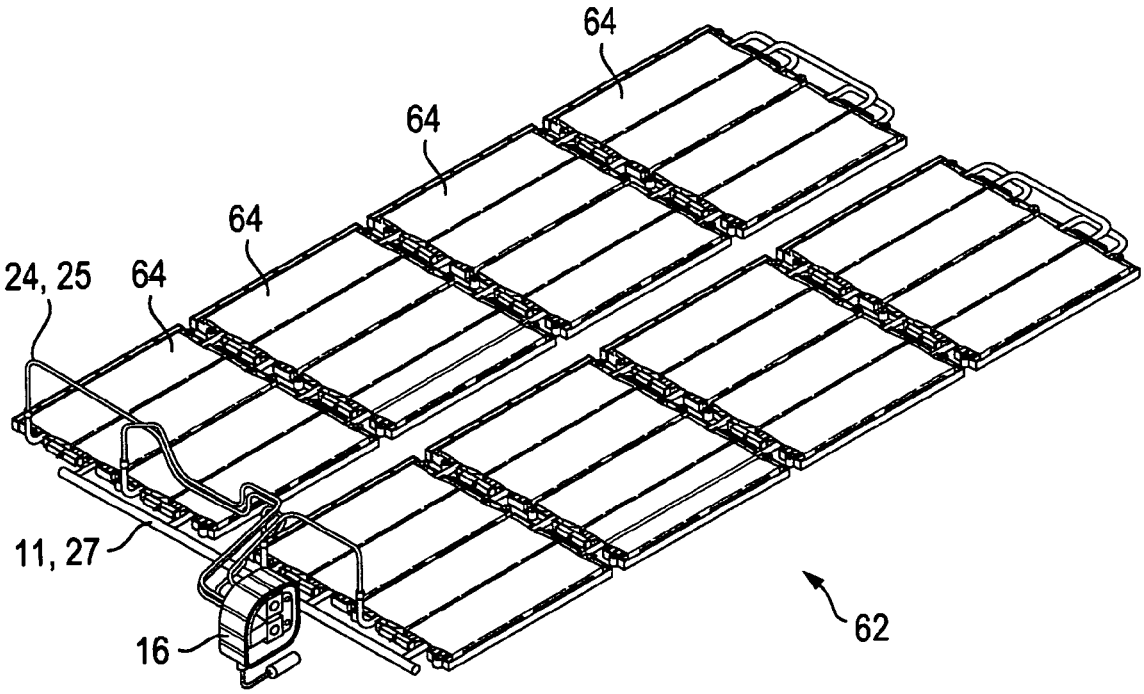
FIG. 7 shows a cooling device for a vehicle propulsion battery, which includes a coupling unit according to the invention.

FIG. 7 shows a cooling device 62 for a vehicle propulsion battery having several cooling bases 64 which are connected to a total of four parallel-connected refrigerant sub-lines 24.

The coupling unit 16 allows the integration of the cooling device 62 in a battery housing, said cooling bases 64 each corresponding to an evaporator 26 of the refrigerant circuit 10 and said cooling bases 64 being disposed within a battery housing which forms the wall 28 of the coupling unit 16. Since the fastening element 48 of the fastening device 44 is accessible from the side of the expansion valve 20 that is opposite the coupling connections 36, 38, it becomes possible to connect and disconnect the fastening device 44 from a side that is outside of the housing of the battery. In this way, in particular the expansion valve 20 can be replaced without having to open the battery housing.

Figure 8:
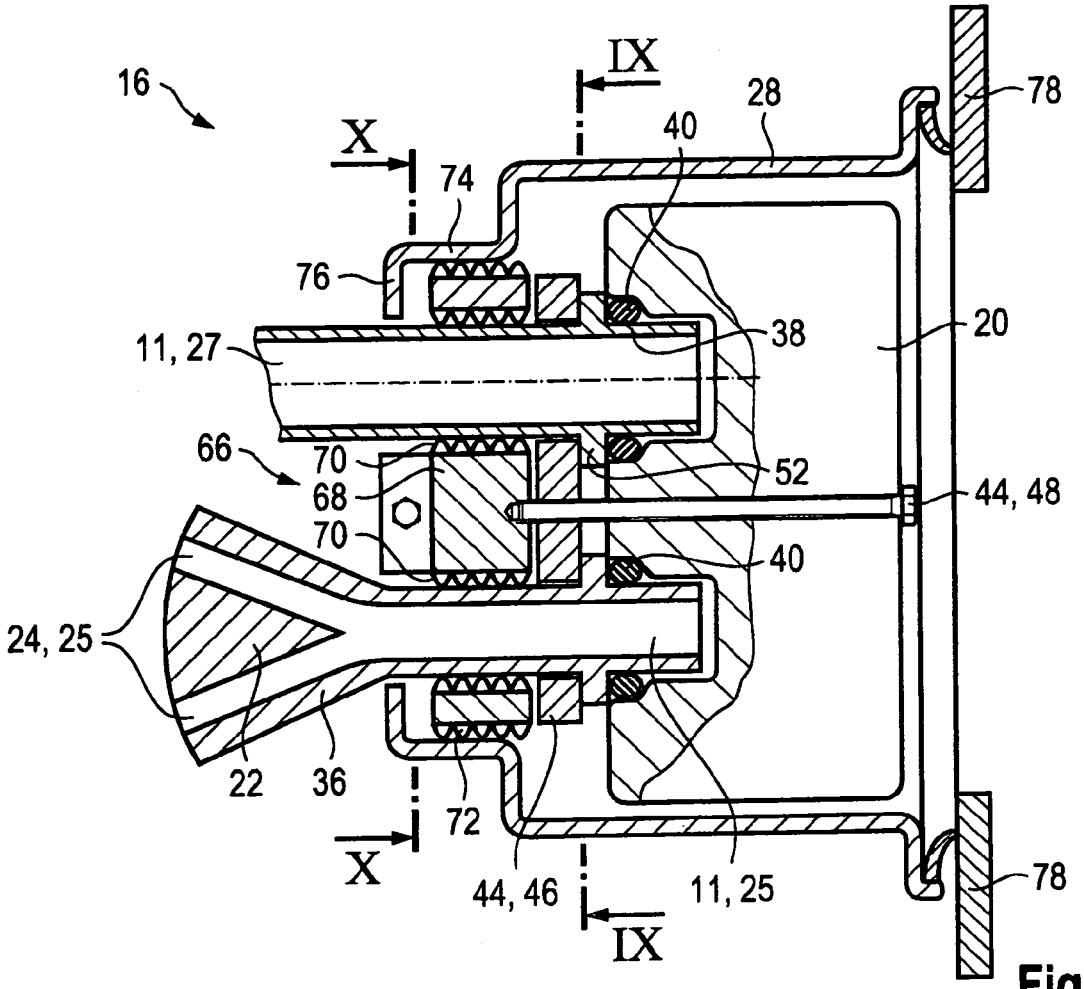
FIG. 8 shows a lateral sectional view of a coupling unit according to a further embodiment of the invention.

FIG. 8 shows a further embodiment of a coupling unit 16. The embodiment differs from the embodiment shown in FIG. 2 in that the common fastening device 44 including the fastening element 48 and the pressing part 46 clamps exclusively the coupling connections 36, 38 and the expansion valve 20 together. Thus, the wall 28 is not connected to the expansion valve 20 via the common fastening device 44.

The fastening element 48 protrudes through the expansion valve 20 and pulls the pressing part 46 and thus the projections 52 in the direction of valve 20, in order to clamp the parts together to form a unit.

Instead of a seal 42 between the expansion valve 20 and the wall 28 (cp. FIG. 2), a seal 66 is here provided between the wall 28 and the refrigerant feed 25 as well as the refrigerant return 27. The seal 66 comprises a sealing body 68 which is made from a substantially rigid material and several sealing elements 70, 72 which are attached to the sealing body 68 on the edge thereof.

Two internal annular sealing elements 70 surround the refrigerant feed 25 and the refrigerant return 27 and thus provide a seal between the sealing body 68 and the refrigerant feed 25 and the refrigerant return 27, respectively.

An outer annular sealing element 72 is disposed on the outer perimeter of the sealing body 68 and provides a seal between the sealing body 68 and the wall 28. The outer sealing element 72 bears here on the inner side against the cylindrical section 74 of the wall 28.

The sealing elements 70, 72 are preferably integrally moulded on the sealing body 68 by way of two-component injection moulding.

The internal and external sealing elements 70, 72 are made from several beads which are arranged in an axial direction next to each other and are made from an elastically deformable material.

Alternatively, also separate sealing elements 70, 72 may be provided, which are for example positively fixed to the sealing body 68.

Since the seal 66 is connected neither to the expansion valve 20 nor to the wall 28, the seal 66 can move relative to the wall section 74 and/or to the refrigerant feed 25 and the refrigerant return 27. The movement of the seal 66 is limited on the side of the expansion valve 20 by the pressing part 46 and on the side of the wall 28 by a wall stop 76. In this way, an axial play between the three components, namely the wall 28, the seal 66 and the expansion valve 20 (including the refrigerant feed 25 and the refrigerant return 27) becomes possible, whilst at the same time a good seal is ensured between the refrigerant lines 11 and the wall 28.

The wall 28 forms a pot-shaped housing in which the expansion valve 20 is accommodated. The pot-shaped housing is immediately followed by a further wall 78 that forms, for example, the housing of a vehicle battery.

Figure 9:
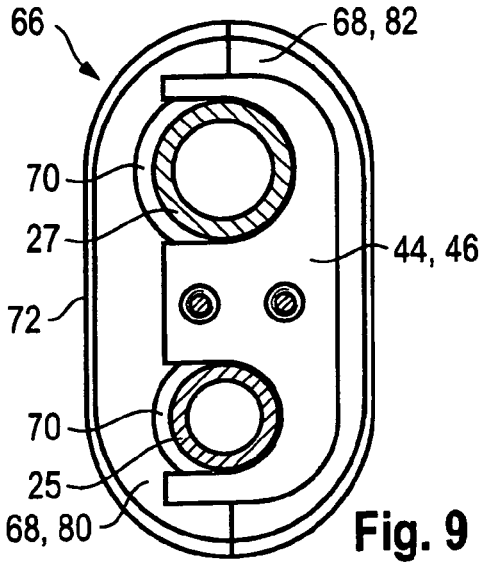
FIG. 9 shows a sectional view of the coupling unit along the line IX-IX of FIG. 8.
Figure 10:
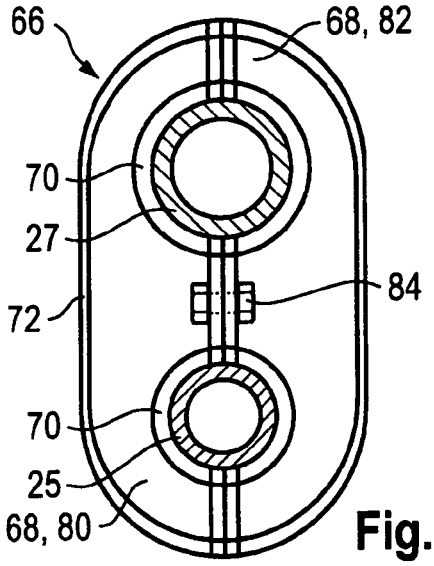
FIG. 10 shows a sectional view of the coupling unit along the line X-X of FIG. 8.

As can be readily seen in both FIGS. 9 and 10, the outer sealing element 72 surrounds the outer circumference of the sealing body 68. Two inner sealing elements 70 surround the two pipes of the refrigerant feed 25 and the refrigerant return 27. On the side of the seal 66 that faces towards the expansion valve 20 (FIG. 9), the comb-shaped pressing part 46 is positioned on the refrigerant feed 25 and the refrigerant return 27.

The sealing body 68 is realized in two pieces and is separated along a plane through the centres of the refrigerant feed 25 and the refrigerant return 27. In this way, the sealing body 68 may simply be mounted to the refrigerant lines 11. On the side of the seal 66 that faces away from the expansion valve 20 (FIG. 10), the two pieces (80, 82) of the sealing body 68 are connected to each other by way of a screw connection 84. The screw connection 84 allows a simple disconnection of the two pieces 80, 82 of the sealing body 68, for example for replacing the seal 66.

Of course, also other connections between the two pieces 80, 82 of the sealing body 68 may be provided.

It is also possible for the sealing body 68 to be divided into even more pieces, for example into three pieces, with the centre piece being located between the refrigerant feed 25 and the refrigerant return 27 and the two other pieces being respectively located on opposite sides of the refrigerant feed 25 and the refrigerant return 27.

The invention claimed is:

1. A coupling unit (16) for connecting refrigerant lines (11) of a refrigerant circuit (10), in particular for cooling a vehicle drive module, the coupling unit (16) including an expansion valve (20) accommodated in the coupling unit (16), the expansion valve (20) separating the refrigerant circuit (10) into first and second sub-areas (30, 32), the coupling unit (16) being connected directly to a refrigerant feed (25) and a refrigerant return (27) for an evaporator (26), the coupling unit (16) comprising coupling connections (36, 38) for the refrigerant feed (25) and the refrigerant return (27) which are detachably connected to the expansion valve (20) via a common fastening device (44), and with the common fastening device (44) having at least one fastening element (48) that is accessible for connecting and disconnecting from a side of the expansion valve (20) that faces away from the coupling connections (36, 38), wherein the coupling connections (36, 38) are axially fixed through a lateral indentation (50) and a lateral projection (52) of a pressing part (46) of the common fastening device (44).

2. The coupling unit (16) as claimed in claim 1, wherein the expansion valve (20) is mounted on a wall (28) of the coupling unit (16).

3. The coupling unit (16) as claimed in claim 2, wherein the common fastening device (44) clamps the wall (28) and the expansion valve (20) together.

4. The coupling unit (16) as claimed in claim 2, wherein a seal (42) is provided between the wall (28) and the expansion valve (20).

5. The coupling unit (16) as claimed in claim 4, wherein the seal (42) is positioned in a groove in the wall (28), with the depth of the groove determining a maximum compression of the seal (42).

6. The coupling unit (16) as claimed in claim 4, wherein the seal (42) is integrally moulded to the wall (28).

7. The coupling unit (16) as claimed in claim 2, wherein the expansion valve (40), the refrigerant feed (25), and the refrigerant return (27) are connected to each other via the fastening device (44) to form a unit that is movably supported on the wall (28) of the coupling unit (16).

8. The coupling unit (16) as claimed in claim 2, further comprising a seal (66) provided between the wall (28) and the refrigerant feed (25) as well as the refrigerant return (27).

9. The coupling unit (16) as claimed in claim 8, wherein the wall (28) has a cylindrical wall section (74) that extends in the direction of the refrigerant feed (25) and the refrigerant return (27), and wherein the seal (66) bears against the refrigerant feed (25), the refrigerant return (27) and the cylindrical wall section (74).

10. The coupling unit (16) as claimed in claim 1, further comprising a seal (40) provided between the coupling connections (36, 38) of the refrigerant return (27) and the refrigerant feed (25) and the expansion valve (20).

11. The coupling unit (16) as claimed in claim 1, wherein at least one coupling connection (36, 38) of the refrigerant feed (25) and/or the refrigerant return (27) has the lateral projection (52) which is located and fixed between the pressing part (46) of the common fastening device (44) and the expansion valve (20).

12. The coupling unit (16) as claimed in claim 1, wherein at least coupling connection (36, 38) of the refrigerant feed (25) and/or the refrigerant return (27) has the lateral indentation (50), in which the common pressing part (46) engages and fixes the coupling connections (36, 38) in an axial direction (A).

13. The coupling unit (16) as claimed in claim 11, wherein the pressing part (46) is a comb-shaped plate.

14. A coupling unit (16) as claimed in claim 1, wherein the coupling unit (16) comprises a refrigerant distributor (22) having at least two sub-lines (24) combined in the refrigerant distributor (22), the refrigerant distributor (22) being a coupling connection (36) of the refrigerant line (11) which is part of the coupling unit (16) and to which the refrigerant line (11) is connected.

15. The coupling unit (16) as claimed in claim 14, wherein the hydraulic cross section of the refrigerant line (11) remains constant from the throttle point (18) to the refrigerant distributor (22) and is preferably between 3 and 8 mm.

16. The coupling unit (16) as claimed in claim 14, wherein the length of the refrigerant line (11) between the throttle point (18) and the refrigerant distributor (22) amounts to 2 to 10 times the hydraulic cross section of the refrigerant line (11).

17. The coupling unit (16) as claimed in claim 1, the coupling connection (36, 38) is produced by directly moulding the refrigerant return (27) and/or the refrigerant feed (25).

18. The coupling unit (16) as claimed in claim 1, wherein the coupling connection (36, 38) is a separately produced component which is made in one piece by turning or milling.

19. A coupling unit (16) for connecting refrigerant lines (11) of a refrigerant circuit (10), in particular for cooling a vehicle drive module, the coupling unit (16) including an expansion valve (20) accommodated in the coupling unit (16), the expansion valve (20) separating the refrigerant circuit (10) into first and second sub-areas (30, 32), the coupling unit (16) being connected directly to a refrigerant feed (25) and a refrigerant return (27) for an evaporator (26), the coupling unit (16) comprising coupling connections (36, 38) for the refrigerant feed (25) and the refrigerant return (27) which are detachably connected to the expansion valve (20) via a common fastening device (44), and with the common fastening device (44) having at least one fastening element (48) that is accessible for connecting and disconnecting from a side of the expansion valve (20) that faces away from the coupling connections (36, 38), wherein the expansion valve (20) is mounted on a wall (28) of the coupling unit (16) and further comprising a seal (66) provided between the wall (28) and the refrigerant feed (25) as well as the refrigerant return (27), wherein the seal (66) comprises a sealing body (68), with inner sealing elements (70) being provided on the sealing body (68) for providing a seal between the sealing body and the refrigerant feed (25) as well as the refrigerant return (27), and an outer sealing element (72) being provided for providing a seal between the sealing body (68) and the wall (28).

20. The coupling unit (16) as claimed in claim 19, wherein the sealing body (68) is in multiple pieces and the pieces (80, 82) of the sealing body (68) are detachably connected to each other.

* * * * *